US010760205B1

(12) United States Patent
McCauley

(10) Patent No.: US 10,760,205 B1
(45) Date of Patent: Sep. 1, 2020

(54) LAUNDRY CONTAINER WITH A CONTAMINANT REDUCTION COVER

(71) Applicant: Edward McCauley, Carmel, IN (US)

(72) Inventor: Edward McCauley, Carmel, IN (US)

( * ) Notice: Subject to any disclaimer, the term of this patent is extended or adjusted under 35 U.S.C. 154(b) by 0 days.

(21) Appl. No.: 16/519,115

(22) Filed: Jul. 23, 2019

(51) Int. Cl.
*D06F 95/00* (2006.01)
*B65D 33/28* (2006.01)

(52) U.S. Cl.
CPC ..... *D06F 95/004* (2013.01); *B65D 33/28* (2013.01)

(58) Field of Classification Search
CPC ..... D06F 95/004; B65D 33/28
USPC ..... 383/75
See application file for complete search history.

(56) References Cited

U.S. PATENT DOCUMENTS 1,526,822 A * 2/1925 Backer ..... A45C 3/04 383/23
2,156,831 A * 5/1939 Andre ..... A63B 69/201 482/86
3,430,754 A 3/1969 Meseke et al.
3,464,733 A * 9/1969 Shaw ..... D06F 5/004 294/68.21
3,583,748 A 6/1971 Arndt
3,977,450 A 8/1976 Schampier
4,175,782 A 11/1979 Neto
4,694,503 A 9/1987 Hydorn
5,118,201 A 6/1992 Cook
5,484,207 A * 1/1996 Schnaars ..... B65D 88/1668 383/67
6,398,410 B1 6/2002 Guerra
6,564,838 B1 5/2003 Cruickshank
6,830,170 B2 12/2004 Abel
7,942,171 B2 5/2011 Hartley
9,156,592 B1 10/2015 Smith
2001/0002020 A1 5/2001 Spero et al.
2006/0204149 A1 9/2006 Guerra
2008/0226204 A1 9/2008 Sabounjian

FOREIGN PATENT DOCUMENTS

JP 3163456 5/2001

* cited by examiner

*Primary Examiner* — Jes F Pascua
(74) *Attorney, Agent, or Firm* — Ice Miller LLP

(57) ABSTRACT

A laundry container with a contaminant reduction cover. Such a laundry container has a bag with a mouth and a base and encloses a volume. The mouth of the bag is affixed to a rigid rim. A covering piece with a first edge and a second edge is provided. The first edge of the covering piece is secured to the bag adjacent the mouth, and the second edge of the covering piece is inserted into the volume. An arm is hingedly attached to the rim. A rope is threaded through the arm and through a sheath at the second edge of the covering piece.

13 Claims, 10 Drawing Sheets

LAUNDRY CONTAINER WITH A CONTAMINANT REDUCTION COVER

BACKGROUND

In a typical industrial laundry facility, clean laundry (such as uniforms, linens, and towels) is moved from place to place in large bags that are transported by an automated material handling system. For example, clean laundry may be discharged from a washing machine into such a bag, and then moved to a dryer and deposited in the dryer. Clean laundry also may be discharged from a dryer into such a bag, and then moved to a folding station and deposited at the folding station.

The top of each laundry bag typically is left open, which exposes clean laundry to dirt, dust, lint, and other particulates that are ambient in the industrial laundry facility. The presence of dirt, dust, lint, and other particulates in clean laundry reduces customer satisfaction and presents a potential health hazard if the end user of the laundered uniforms, linens, and/or towels is allergic to or otherwise sensitive to such things.

Moreover, in order to control dirt, dust, lint, and other ambient particulates, a typical industrial laundry facility undergoes periodic "blowdowns," where the machinery and structural elements of the industrial laundry facility are exposed to pressurized air for the purpose of directing the dirt, dust, lint, and other particulates to a collection station where the dirt, dust, lint, and other particulates can be removed from the industrial laundry facility. While the "blowdown" process is effective in reducing the presence of dirt, dust, lint, and other particulates in the industrial laundry facility, it may have the side effect of temporarily exposing the open laundry bags to an even greater concentration of dirt, dust, lint, and other particulates, which may exacerbate customer dissatisfaction as well as the aforementioned health hazards.

For the foregoing reasons, it is desired to provide a system for reducing the exposure of clean laundry to ambient dirt, dust, lint, and other particulates.

SUMMARY

The present disclosure includes disclosure of a laundry container with a contaminant reduction cover. In at least one embodiment, such a laundry container comprises a rigid rim; a bag comprising a mouth and a base and enclosing a volume, the mouth affixed to the rigid rim; a covering piece, the covering piece having a first edge and a second edge, the first edge of the covering piece secured to the bag adjacent the mouth, the second edge of the covering piece inserted into the volume, the second edge comprising a sheath; an arm, the arm hingedly attached to the rim and extending from the rim, the arm comprising first and second passageways extending longitudinally therethrough; and a rope, the rope threaded through the first and second passageways and the sheath.

In at least one embodiment, a laundry container according to the present disclosure comprises a rope guide affixed to the rim, the rope guide comprising a hollow tube and a latching mechanism, the rope threaded through the hollow tube. In at least one embodiment, such a laundry container also comprises a rope catch affixed to the rope, the rope catch configured to engage with the latching mechanism.

In at least one embodiment, a laundry container according to the present disclosure comprises an arm that is rotatable from a relaxed position to an actuated position.

In at least one embodiment, a laundry container according to the present disclosure comprises a covering piece that can transition from a relaxed position wherein the covering piece is within the volume of the bag, to an actuated position wherein the covering piece covers at least a majority of the mouth.

In at least one embodiment of a laundry container according to the present disclosure, when a force is exerted on the rope, the rope retracts from the sheath, thereby moving the second edge of the covering piece to a cinched arrangement. In at least one embodiment of a laundry container according to the present disclosure, the engagement of a rope catch and a latching mechanism holds the second edge of the covering piece in the cinched arrangement after the force is removed.

In at least one embodiment of a laundry container according to the present disclosure, when a force is exerted on the rope, the rope retracts from the first and second passageways, thereby moving the arm to an actuated position. In at least one embodiment of a laundry container according to the present disclosure, the engagement of a rope catch and a latching mechanism holds the arm to the actuated position after the force is removed.

BRIEF DESCRIPTION OF THE DRAWINGS

The features and advantages of this disclosure, and the manner of attaining them, will be more apparent and better understood by reference to the following descriptions of the disclosed methods and systems, taken in conjunction with the accompanying drawings, wherein.

DESCRIPTION

Figure 1:
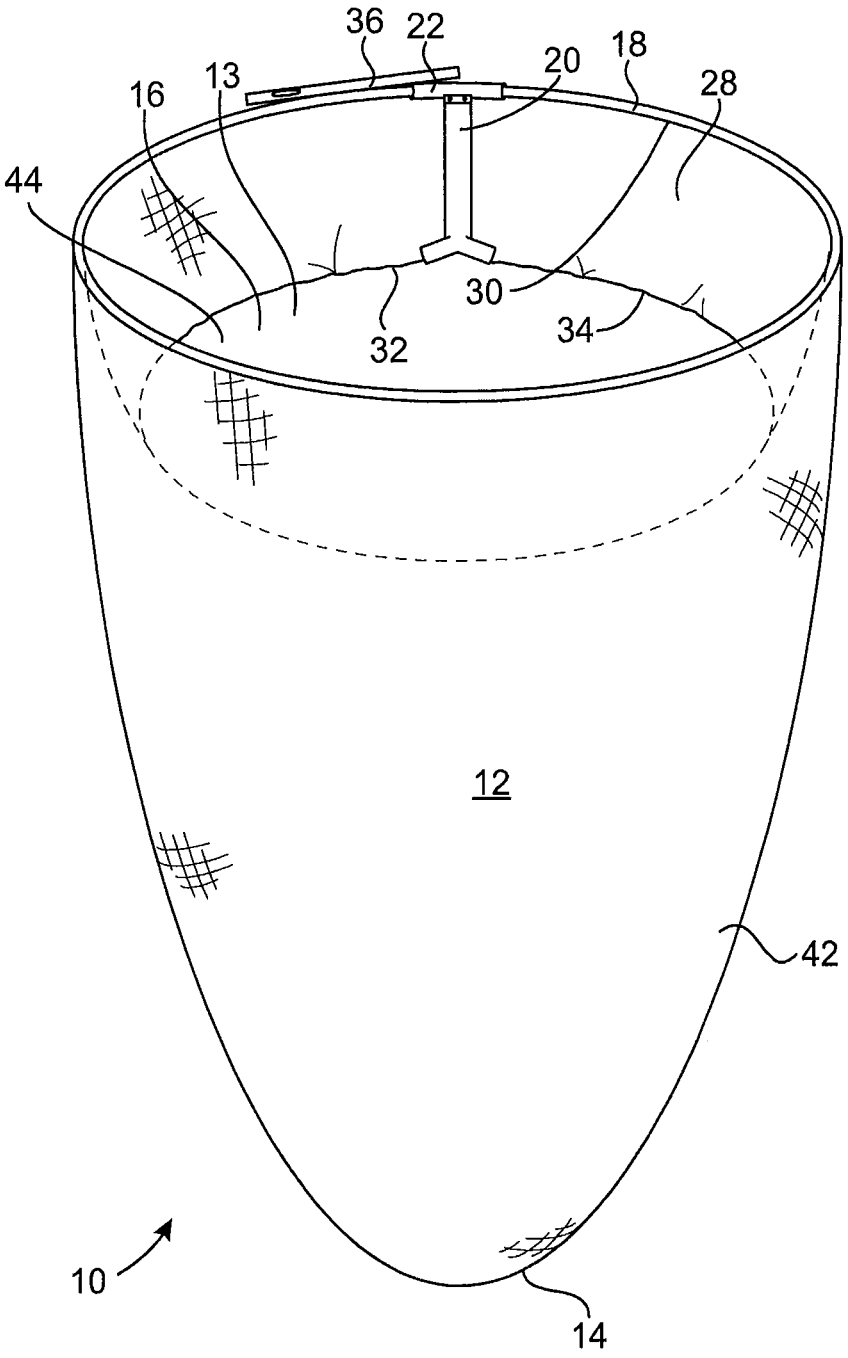
FIG. 1 shows a perspective view of a laundry container with a contaminant reduction cover according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIGS. 1-13 show laundry container 10 and its components, according to at least one embodiment of the present disclosure.

Laundry container 10 according to at least one embodiment of the present disclosure comprises bag 12 enclosing a volume 13. Bag 12 is constructed of a material, such as, for example, nylon, polyester, cotton, canvas, and the like, suitable for handling laundry or other intended contents. Bag 12 comprises base 14, mouth 16, outer surface 42, and inner surface 44. In at least one embodiment, base 14 is permanently closed, so as to retain laundry or other contents within bag 12. In such an embodiment, laundry or other contents may be loaded into and removed from bag 12 only by way of mouth 16. In another embodiment, base 14 is equipped with a mechanism to open and close base 14. For example, base 14 may be equipped with a drawstring closure or a closure deploying hook and loop fasteners. In such an embodiment, the mechanism of base 14 may be closed when it is desired to retain laundry or other contents within bag 12. The mechanism of base 14 then may be released to open base 14 and discharge the laundry or other contents through base 14 of bag 12.

Figure 2:
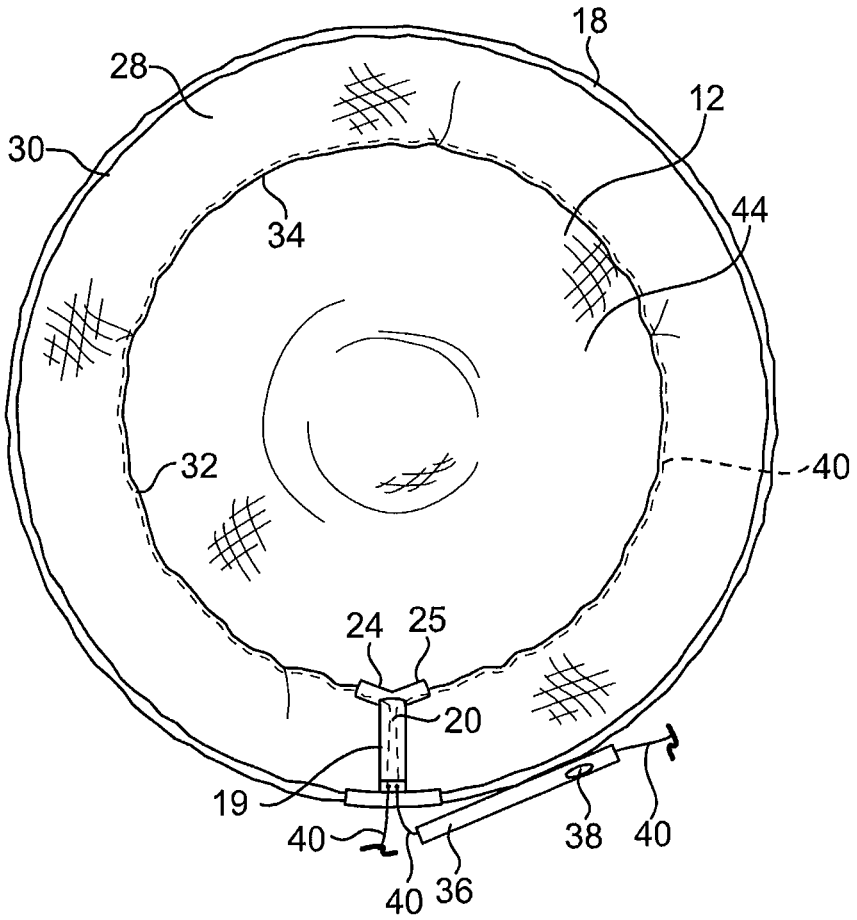
FIG. 2 shows a top view of a laundry container with a contaminant reduction cover according to at least one embodiment of the present disclosure.

Mouth 16 of bag 12 comprises a rigid rim 18, which holds mouth 16 in an open position. Rim 18 may be constructed of any rigid material that is suitable for the environment into which bag 12 is deployed, such as, for example, carbon steel, stainless steel, aluminum, polypropylene, and the like. Rim 18 may be incorporated into mouth 16, such as by sewing or otherwise affixing mouth 16 around rim 18. Mouth 16 also may be releasably coupled to rim 18 by way of fasteners and/or other methods, so that bag 12 may be removed from rim 18 for cleaning, storage, etc. In at least one non-limiting embodiment of laundry container 10 according to the present disclosure, rim 18 has a generally circular shape, as is shown in FIG. 2. However, other shapes of rim 18, such as rectangles and ellipses, may be used and are within the scope of the present disclosure.

Figure 3:
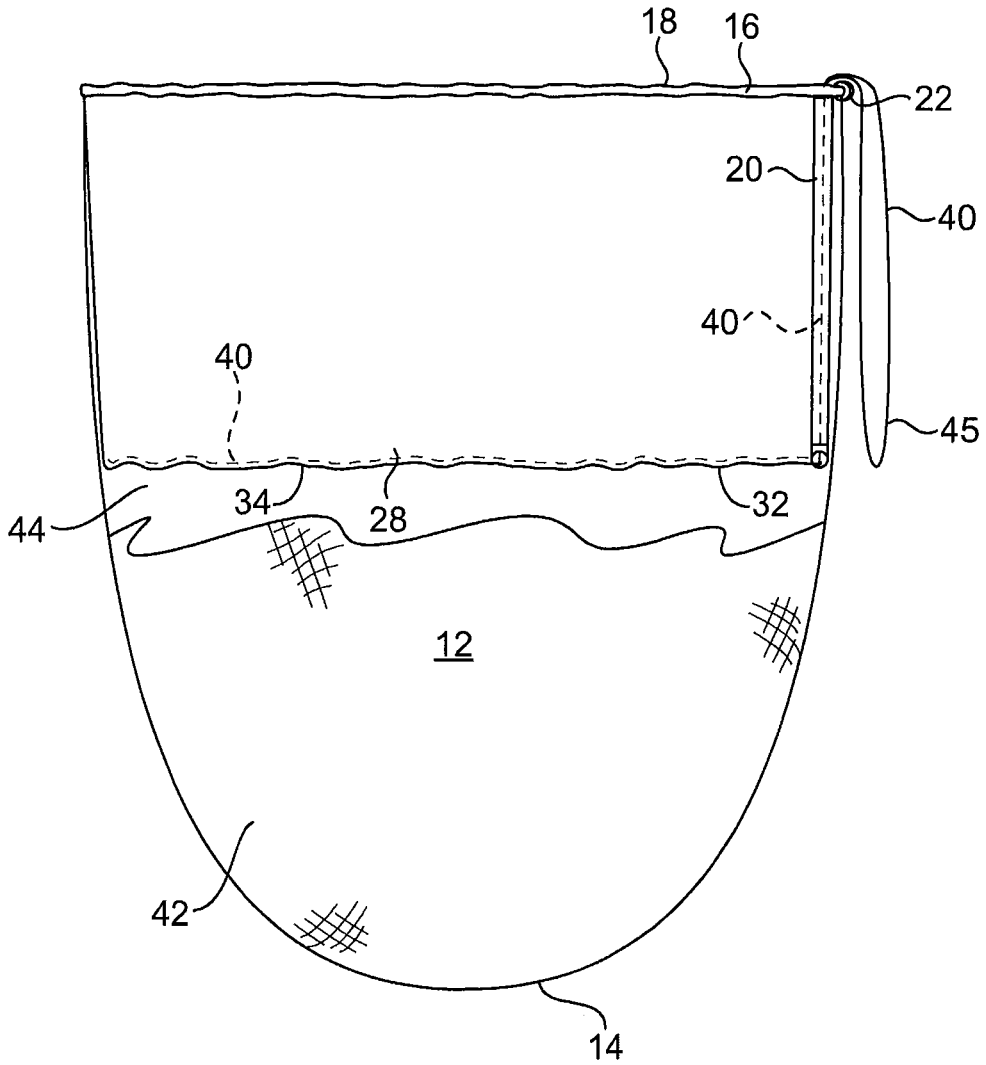
FIG. 3 shows a partially cutaway side view of a laundry container with a contaminant reduction cover according to at least one embodiment of the present disclosure.
Figure 4:
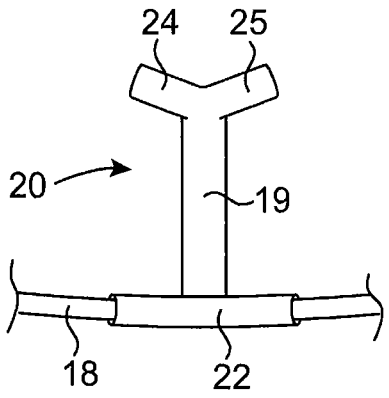
FIG. 4 shows a top view of components of a laundry container with a contaminant reduction cover according to at least one embodiment of the present disclosure.
Figure 5:
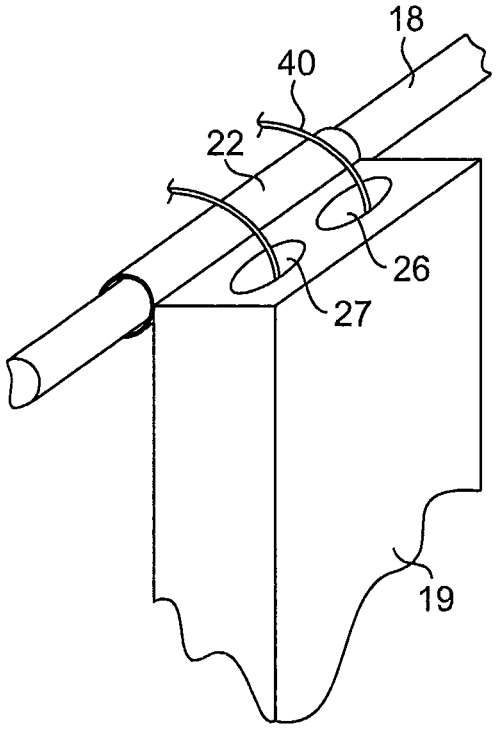
FIG. 5 shows a perspective view of components of a laundry container with a contaminant reduction cover according to at least one embodiment of the present disclosure.
Figure 6:
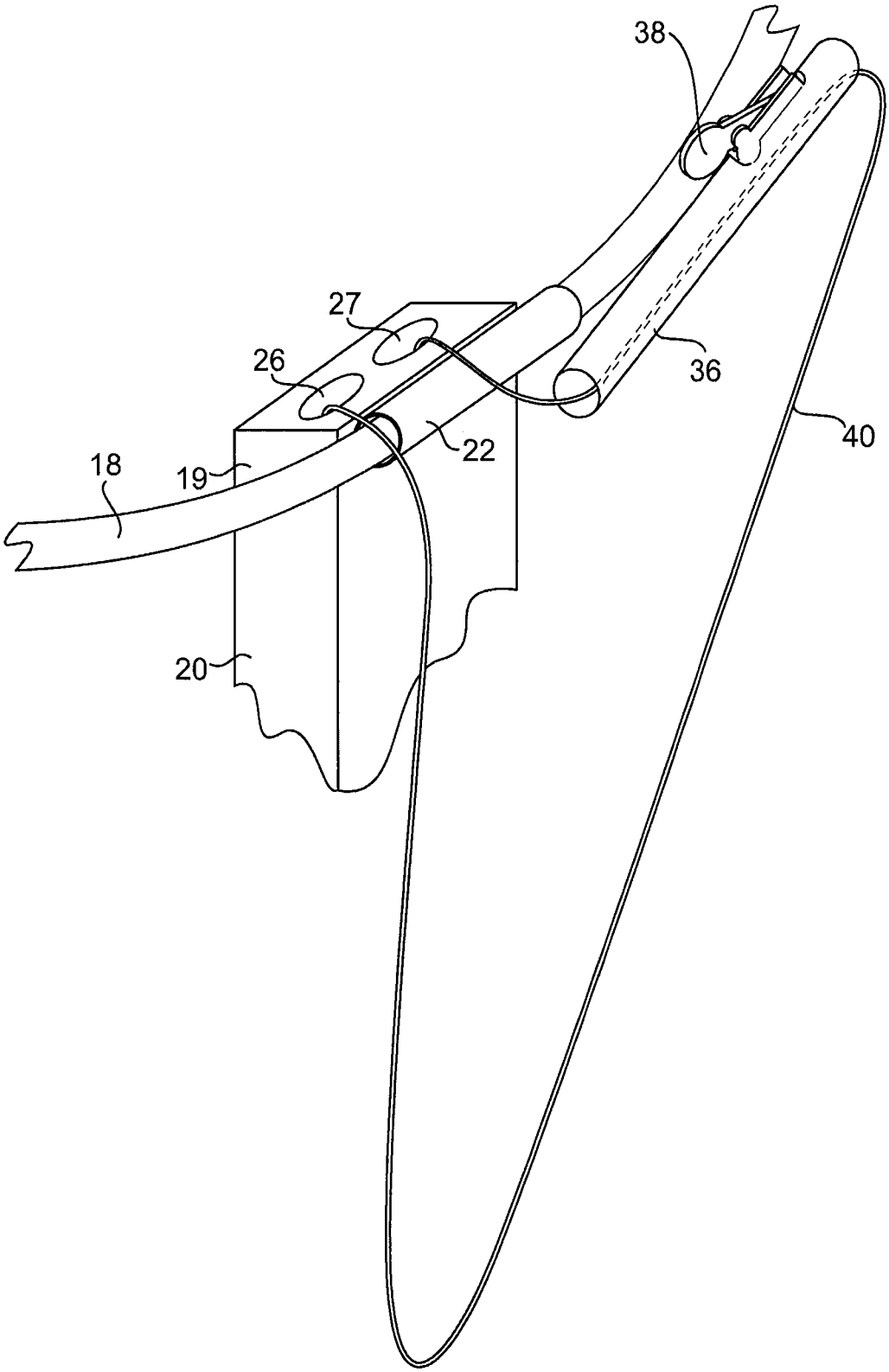
FIG. 6 shows a perspective view of components of a laundry container with a contaminant reduction cover according to at least one embodiment of the present disclosure.
Figure 7:
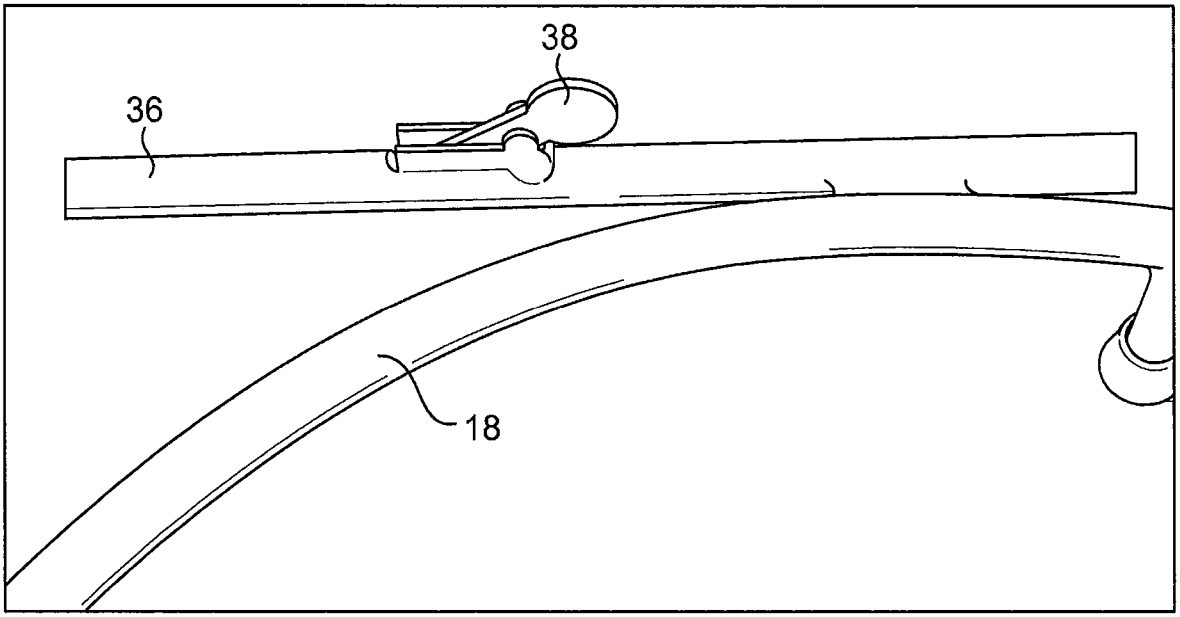
FIG. 7 shows a perspective view of components of a laundry container with a contaminant reduction cover according to at least one embodiment of the present disclosure.
Figure 8:
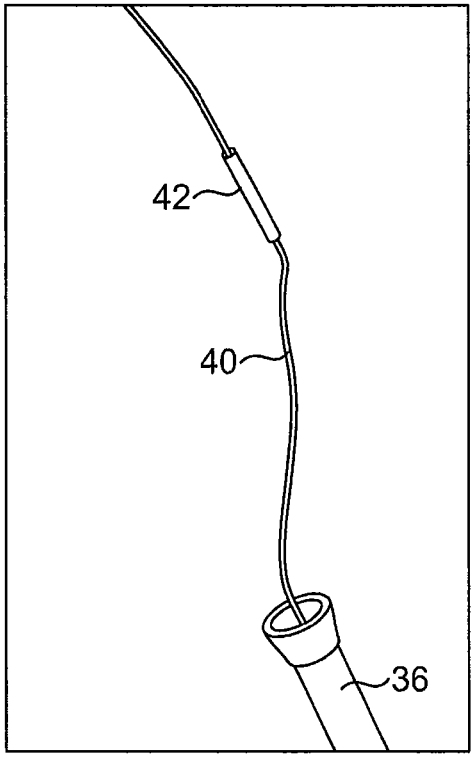
FIG. 8 shows a perspective view of components of a laundry container with a contaminant reduction cover according to at least one embodiment of the present disclosure.
Figure 9:
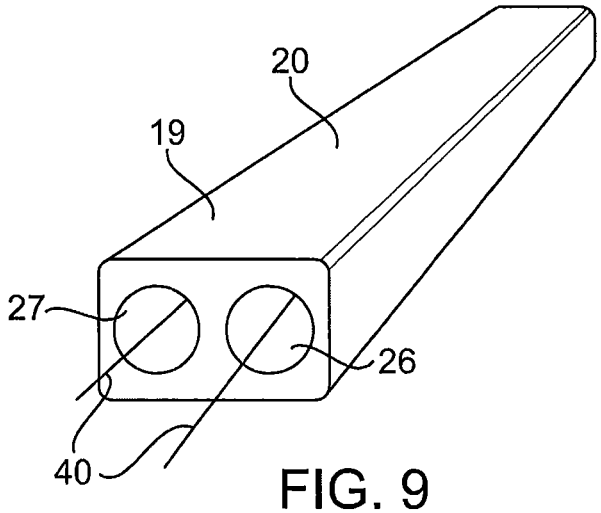
FIG. 9 shows a perspective view of components of a laundry container with a contaminant reduction cover according to at least one embodiment of the present disclosure.
Figure 10:
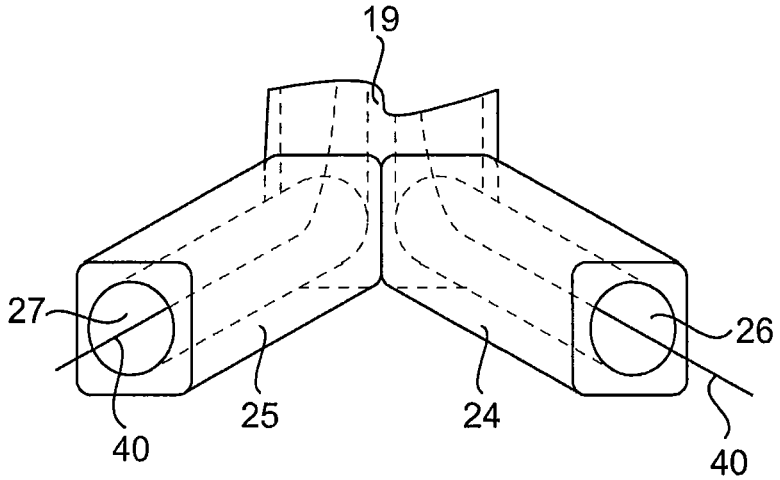
FIG. 10 shows a perspective view of components of a laundry container with a contaminant reduction cover according to at least one embodiment of the present disclosure.

Mouth 16 of bag 12 is outfitted with covering piece 28. In at least one embodiment, covering piece 28 is constructed of the same material as bag 12. In other embodiments, covering piece 28 is constructed of a different material from the material of bag 12. Covering piece 28 comprises outer dimensions sized to fit within rim 18 and the inner dimension of bag 12. Covering piece 28 comprises a first edge 30 and a second edge 32. First edge 30 of covering piece 28 is sewn or otherwise affixed to mouth 16 of bag 12, or to an internal surface of bag 12 adjacent to mouth 16. Second edge 32 terminates in sheath 34, which extends along a majority of second edge 32. As shown in FIGS. 1-3, covering piece 28 drapes into the internal volume 13 of bag 12 until covering piece 28 is actuated as discussed hereinafter.

Laundry container 10 according to the present disclosure comprises arm 20. Arm 20 is an elongate rigid or semi-rigid member comprising trunk 19, first end 21, and opposing second end 23. In at least one embodiment, first end 21 is attached to hinge 22, which is attached to rim 18. Second end 23 extends away from rim 18. In at least one embodiment, arm 20 is sized so that the length from first end 21 to opposing second end 23 is approximately the same as the distance from rim 18 to the geometric center of the area encompassed by rim 18. In at least one embodiment of arm 20, second end 23 is bifurcated to form branches 24, 25. Arm 20 comprises hollow passageways 26, 27 that extend through arm 20, which can be seen in shown in FIGS. 5-8. Passageway 26 begins at first end 21, extends through trunk 19, and through branch 24 of arm 20. Passageway 27 begins at first end 21, extends through trunk 19, and through branch 25 of arm 20.

Laundry container 10 according to at least one embodiment of the present disclosure comprises at least one rope guide 36, which is coupled to rim 18. Rope guide 36 comprises hollow passageway 37 extending therethrough. Rope guide 36 also comprises latching mechanism 38, a portion of which extends into passageway 37.

Laundry container 10 according to at least one embodiment of the present disclosure comprises rope 40. Rope 40 comprises a rope or another elongate flexible material. Rope 40 is threaded through guide 36, passageway 26, sheath 34, and passageway 27. In at least one embodiment of the present disclosure, a slack portion 45 of rope 40 is located outside of bag 12. In at least one embodiment of the present disclosure, rope 40 comprises rope catch 46, which expands the size of a localized area of rope 40. Rope catch 46 a may be a ferrule or other device affixed to rope 40. Rope catch 46 is configured to travel freely inside passageway 37, but also configured to engage with latching mechanism 38 inside passageway 37.

FIGS. 1-3 show laundry container 10 according to at least one embodiment of the present disclosure in an unactuated state. As shown in FIGS. 1-3, bag 12 is suspended from rim 18, and there is no, or alternatively very limited, tensile force on rope 40. The tensile force on rope 40 is insufficient to overcome the gravitational pull on covering piece 28 and arm 20. As a result, covering piece 28 drapes slackly into the internal volume 13 of bag 12, and second end 32 is unfurled within the internal volume 13 of bag 12. The weight of arm 20 also causes arm 20 to rotate at hinge 22 and tip into the internal volume 13 of bag 12.

Figure 11:
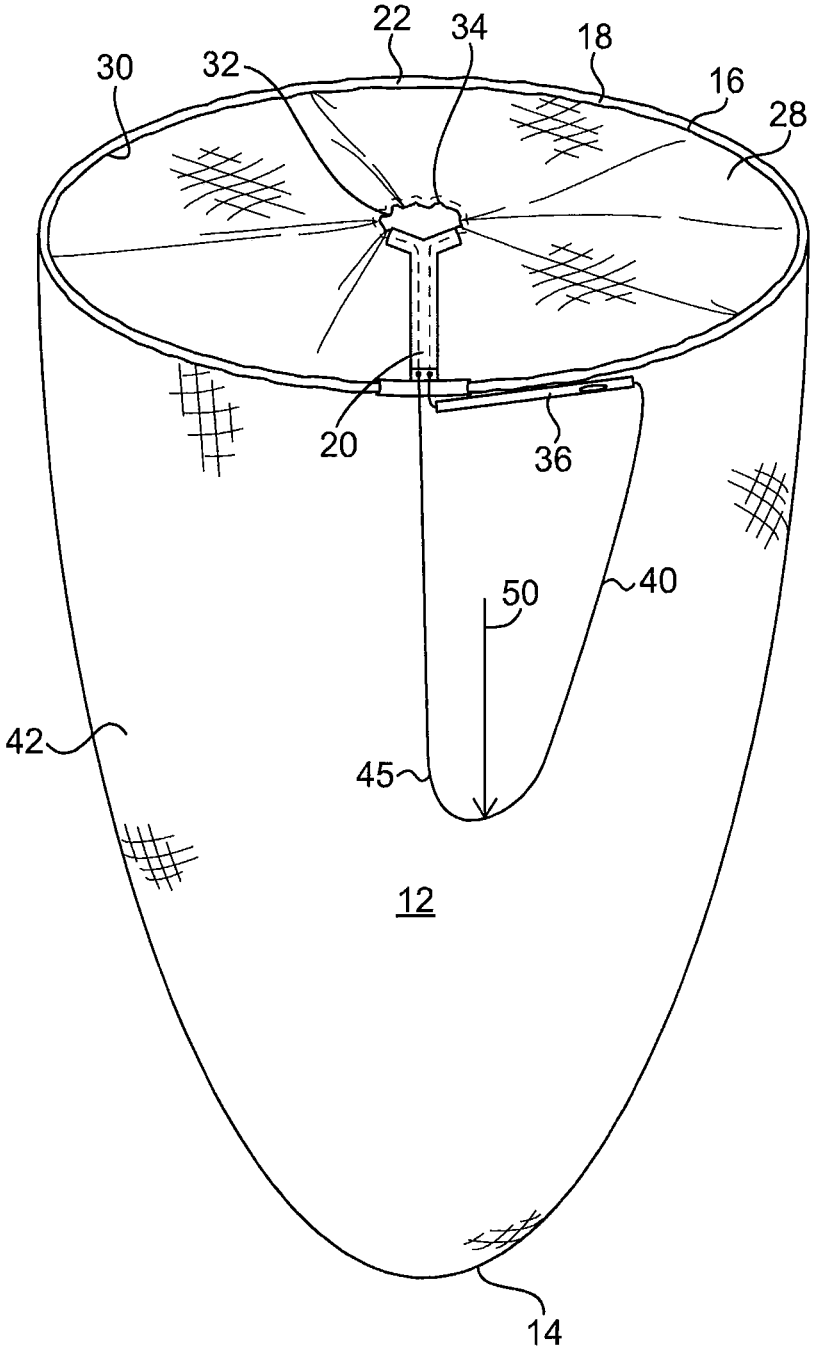
FIG. 11 shows a perspective view of a laundry container with a contaminant reduction cover according to at least one embodiment of the present disclosure.
Figure 12:
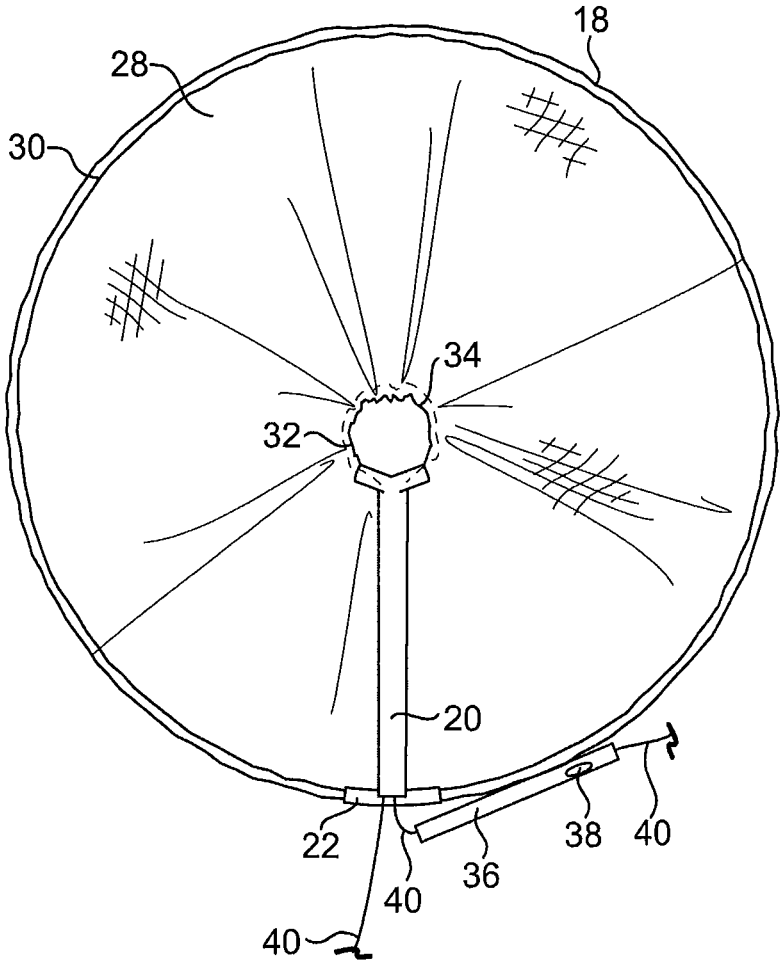
FIG. 12 shows a top view of a laundry container with a contaminant reduction cover according to at least one embodiment of the present disclosure.
Figure 13:
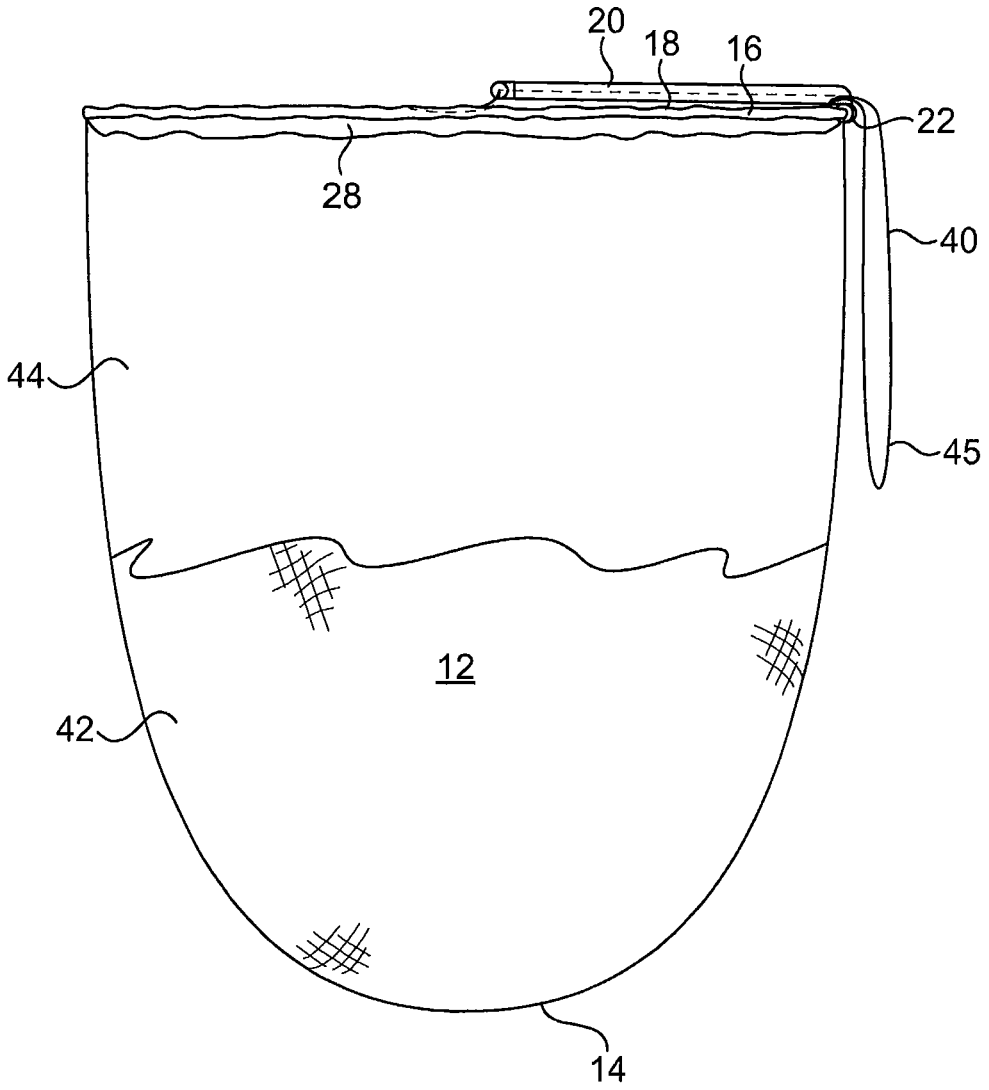
FIG. 13 shows a partially cutaway side view of a laundry container with a contaminant reduction cover according to at least one embodiment of the present disclosure.

FIGS. 11-13 show laundry container 10 according to at least one embodiment of the present disclosure in an actuated state. To actuate laundry container 10, a force 50 is applied to rope 40. In at least one non-limiting embodiment, force 50 is applied to slack portion 45 of rope 40 by, for example, a mechanical device. The force 50 applied to rope 40 causes rope 40 to retract from guide 36, passageway 26, sheath 34, and passageway 27. The retraction of rope 40 from passageways 26, 27 causes arm 20 to rotate at hinge 22 until arm 20 is lifted out of the internal volume 13 of bag 12. The retraction of rope 40 from passageway 26, sheath 34, and passageway 27 causes second edge 32 to be lifted out of the internal volume 13 of bag 12 and to be cinched into a closed arrangement, as shown in FIGS. 11-13. In an embodiment comprising latching mechanism 38 and rope catch 46, force 50 moves rope catch 46 into engagement with latching mechanism 38. Force 50 is applied until latching mechanism 38 captures rope catch 46, thereby locking rope 40 into an actuated position. Force 50 then may be removed from rope 40, and the interaction of latching mechanism 38 and rope catch 46 will maintain the tension on rope 40.

When actuated by way of force 50 applied to rope 40, covering piece 28 is pulled into a configuration substantially parallel with the plane of rim 18, as shown in FIGS. 11-13. A slight gap may remain at the center of covering piece 28, but in this configuration covering piece 28 forms a shield substantially preventing the flow of lint and other airborne contaminants into the internal volume 13 of bag 12. Because rope 40 is locked into place by the interaction of latching mechanism 38 and rope catch 46, covering piece 28 will be held in this position until rope catch 46 is release from locking mechanism 38.

While this disclosure has been described as having preferred designs, the apparatus and methods according to the present disclosure can be further modified within the scope and spirit of this disclosure. This application is therefore intended to cover any variations, uses, or adaptations of the disclosure using its general principles. For example, any method disclosed herein and in the appended claims represent one possible sequence of performing the steps thereof. A practitioner may determine in a particular implementation that a plurality of steps of one or more of the disclosed methods may be combinable, or that a different sequence of steps may be employed to accomplish the same results. Each such implementation falls within the scope of the present disclosure as disclosed herein and in the appended claims. Furthermore, this application is intended to cover such departures from the present disclosure as come within known or customary practice in the art to which this disclosure pertains.

What is claimed is:

1. A laundry container comprising:

a rigid rim;

a bag comprising a mouth and a base and enclosing a volume, said mouth affixed to said rigid rim;

a covering piece, said covering piece having a first edge and a second edge, said first edge of said covering piece secured to said bag adjacent said mouth, said second edge of said covering piece inserted into said volume, said second edge comprising a sheath;

an arm, said arm hingedly attached to said rim and extending from said rim, said arm comprising first and second passageways extending longitudinally therethrough; and a rope, said rope threaded through said first and second passageways and said sheath.

2. The laundry container of claim 1, further comprising:

a rope guide affixed to said rim, said rope guide comprising a hollow tube and a latching mechanism, said rope threaded through said hollow tube.

3. The laundry container of claim 2, further comprising:

a rope catch affixed to said rope, said rope catch configured to engage with said latching mechanism.

4. The laundry container of claim 1, wherein said arm is rotatable from a relaxed position to an actuated position.

5. The laundry container of claim 1, wherein said covering piece can transition from a relaxed position wherein said covering piece is within said volume of said bag, to an actuated position wherein said covering piece covers at least a majority of said mouth.

6. The laundry container of claim 1, wherein when a force is exerted on said rope, said rope retracts from said sheath, thereby moving said second edge of said covering piece to a cinched arrangement.

7. The laundry container of claim 6, further comprising:

a rope guide affixed to said rim, said rope guide comprising a hollow tube and a latching mechanism, said rope threaded through said hollow tube.

8. The laundry container of claim 7, further comprising:

a rope catch affixed to said rope, said rope catch configured to engage with said latching mechanism, wherein said force moves said rope catch into engagement with said latching mechanism.

9. The laundry container of claim 8, wherein the engagement of said rope catch and said latching mechanism holds said second edge of said covering piece in said cinched arrangement after said force is removed.

10. The laundry container of claim 1, wherein when a force is exerted on said rope, said rope retracts from said first and second passageways, thereby moving said arm to an actuated position.

11. The laundry container of claim 10, further comprising:

a rope guide affixed to said rim, said rope guide comprising a hollow tube and a latching mechanism, said rope threaded through said hollow tube.

12. The laundry container of claim 11, further comprising:

a rope catch affixed to said rope, said rope catch configured to engage with said latching mechanism, wherein said force moves said rope catch into engagement with said latching mechanism.

13. The laundry container of claim 12, wherein the engagement of said rope catch and said latching mechanism holds said arm in said actuated position after said force is removed.

* * * * *